US007628635B2

(12) United States Patent
Ma

(10) Patent No.: US 7,628,635 B2
(45) Date of Patent: Dec. 8, 2009

(54) ELECTRICAL CONNECTOR WITH ACTUATING MECHANISM

(75) Inventor: Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/983,020

(22) Filed: Nov. 5, 2007

(65) Prior Publication Data

US 2008/0108239 A1 May 8, 2008

(30) Foreign Application Priority Data

Nov. 3, 2006 (CN) ..... 200620126773

(51) Int. Cl.
*H01R 13/625* (2006.01)

(52) U.S. Cl. ..... 439/342

(58) Field of Classification Search ..... 439/342, 439/259, 260–266, 68
See application file for complete search history.

(56) References Cited

U.S. PATENT DOCUMENTS 6,004,152 A * 12/1999 Walkup et al. ..... 439/342
6,338,640 B1 1/2002 Lin
6,609,926 B1 8/2003 Chen et al.
6,669,500 B1 * 12/2003 Ju ..... 439/342
6,746,262 B2 * 6/2004 He et al. ..... 439/342
7,070,437 B1 * 7/2006 Huang ..... 439/342

FOREIGN PATENT DOCUMENTS

CN 2833962 Y 11/2006

* cited by examiner

*Primary Examiner*—Alexander Gilman
(74) *Attorney, Agent, or Firm*—Andrew C. Cheng; Wei Te Chung; Ming Chieh Chang

(57) ABSTRACT

An electrical connector (1) includes a base (10) defining a number of contact-receiving passages, a number of contacts received in the contact-receiving passages of the base, a cover (11) mounted to an upper surface of the base, and an actuating mechanism (12) disposed between the base and the cover. The actuating mechanism includes a rotator (14) penetrating through the cover and a transmission element (16) connecting with the rotator, the base and the cover. The rotation of the rotator drives the rotation of the transmission element which is capable of driving the cover to slide relative to the base.

18 Claims, 8 Drawing Sheets

ELECTRICAL CONNECTOR WITH ACTUATING MECHANISM

BACKGROUND OF THE INVENTION

1. Field of the Invention

The present invention generally relates to an electrical connector, and more particularly to an electrical connector for removably mounting a chip module to a printed circuit board. This application relates to the copending application titled "ZERO INSERTION FORCE CONNECTOR WITH AN IMPROVED DRIVER MEMBER" filed Oct. 31, 2007, disclosing essentially the similar embodiment and having the same applicant and the same assignee with the instant invention.

2. Description of Related Art

China Patent No. 2501204Y disclosed an electrical connector for electrically connecting a chip module to a printed circuit board. The electrical connector comprises a base defining a plurality of contact-receiving slots, a plurality of contacts received in the contact-receiving slots, a cover slidably assembled to the cover and defining a plurality of through slots, and a rotator. The rotator is rotatably received in the base and the cover and is capable of actuating the cover to slide relative to the base via its self-rotation. Then, the pins of the chip module insert through the through slots of the cover into the contact-receiving slots of the base. The rotator is rotated, again to rotate the cover to slide relative to the base along opposite direction. The pins of the chip module moves together with the cover to electrically contact the contacts received in the contact-receiving slots, thus, electrical connection between the chip module and a printed circuit board below the base.

However, the electrical connector with above structures has at least the shortcomings as follows: firstly, it is difficult to control the skew force exerted to the rotator. Too large skew force will cause damage to the electrical connector. Further, a metal plate is molded with the base or the cover adjacent to the rotator to separate the rotator from the plastic material of the base and the cover. However, the metal plate molded with the base or the cover causes lower production efficiency and cannot satisfy the demands of customers.

Therefore, it is desired to provide an improved electrical connector to stress the problems mentioned above.

BRIEF SUMMARY OF THE INVENTION

Accordingly, an object of the present invention is to provide an electrical connector with improved structures for preventing damage to the electrical connector when exerted too large skew force to an actuator thereof.

In order to achieve the above-mentioned object, an electrical connector comprises a base defining a plurality of contact-receiving passages, a plurality of contacts received in the contact-receiving passages of the base, a cover mounted to an upper surface of the base, and an actuating mechanism disposed between the base and the cover. The actuating mechanism comprises a rotator penetrating through the cover and a transmission element connecting with the rotator, the base and the cover. The rotation of the rotator drives the rotation of the transmission element which is capable of driving the cover to slide relative to the base.

Other objects, advantages and novel features of the invention will become more apparent from the following detailed description of the present embodiment when taken in conjunction with the accompanying drawings.

DETAILED DESCRIPTION OF THE INVENTION

Figure 1:
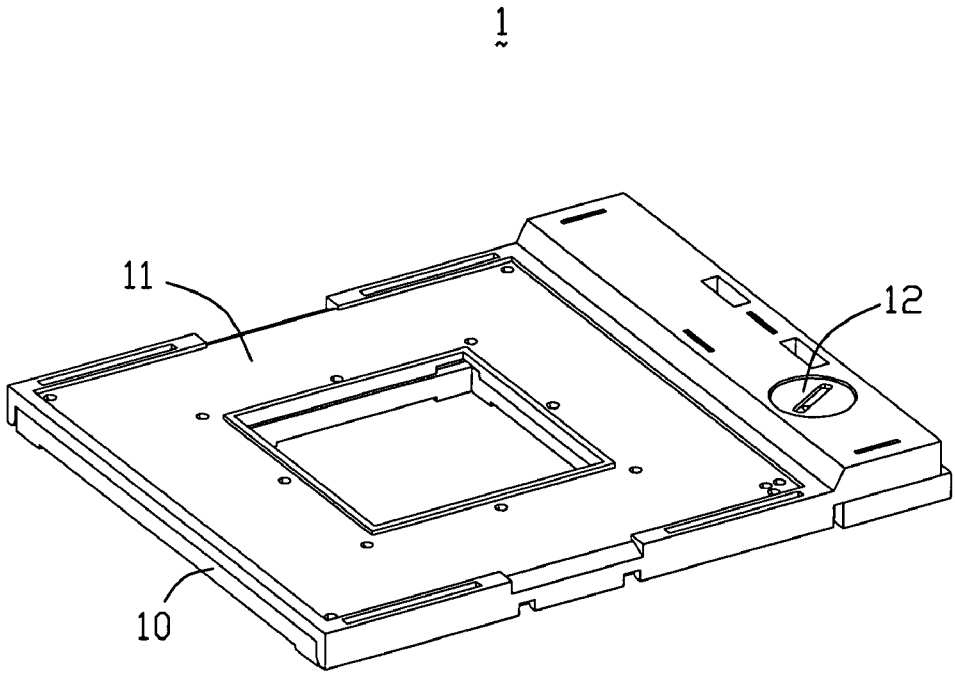
FIG. 1 is an assembled, perspective view of an electrical connector in accordance with the present invention.

Reference will now be made to the drawing figures to describe the present invention in detail.

Figure 2:
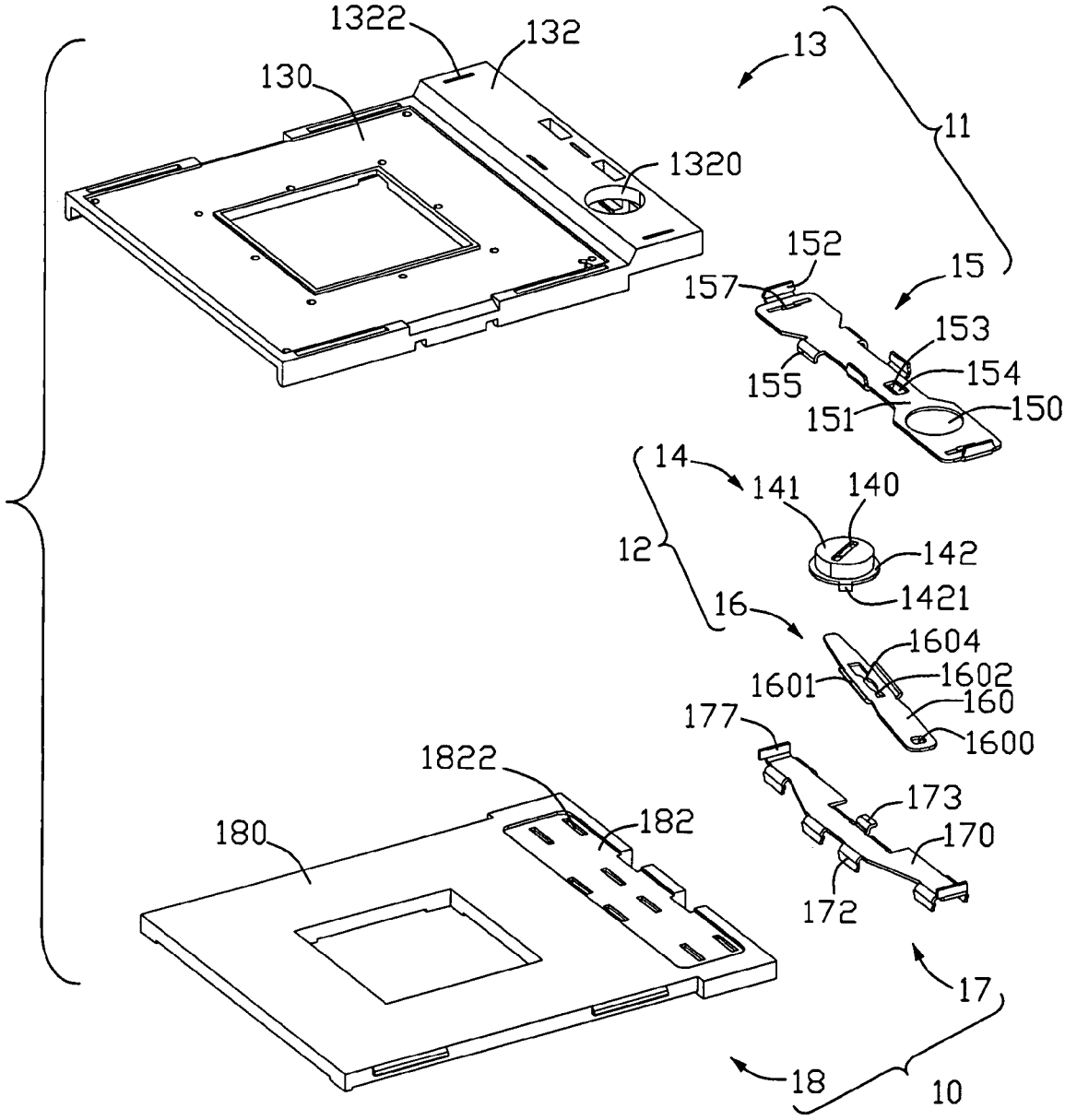
FIG. 2 is an exploded, perspective view of the electrical connector shown in FIG. 1.
Figure 3:
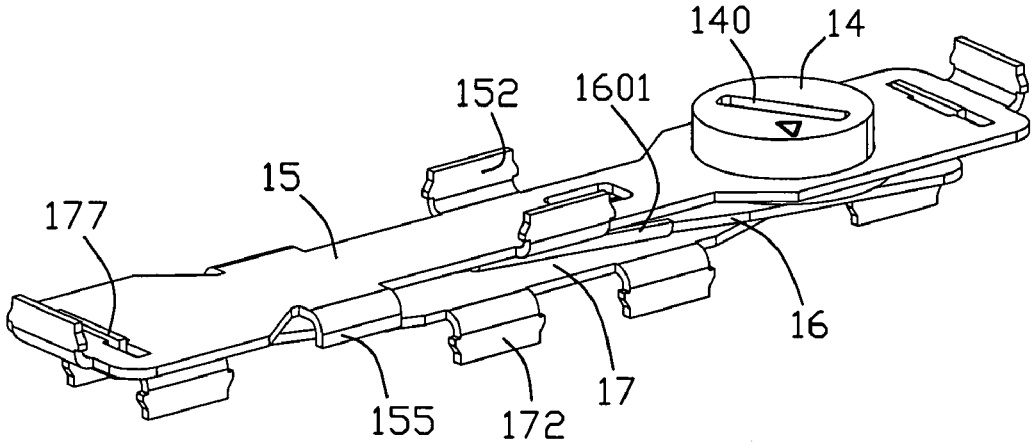
FIG. 3 is an assembled view of an actuating mechanism of the electrical connector.

Please refer FIGS. 1-3, an electrical connector 1 for electrically connecting a chip module (not shown) to a printed circuit board (not shown) and comprises a base 10, a plurality of contacts (not shown), a cover 11 mounted to an upper surface of the base 10, and an actuating mechanism 12 for actuating the cover 11 to slide relative to the base 10. In the preferred embodiment of the present invention, the electrical connector 1 is a ZIF type socket.

The cover 11 is movably assembled to the base 10 and comprises a cover plate 13 and a first connecting The cover 11 is moveably assembled to the base 10 and comprises a cover plate 13 made from insulative material and a first connecting member 15 retained to bottom side of the cover plate 13. The cover plate 13 comprises an accommodating portion 130 for accommodating pins (not shown) of the chip module and a head portion 132 extending out from one side edge of the accommodating portion 130 with a top surface higher than that of the accommodating portion 130. A round cover-receiving slot 1320 is defined through the head portion 132 along up-to-down direction. Pairs of cover retaining slits 1322 are defined in outer periphery of the head portion 132 in symmetrical relationship.

The first connecting member 15 is retained to the cover plate 13 and comprises a first base portion 151 in substantially board shape. The first base portion 151 defines a circular hole 150 corresponding to the position and shape of the cover-receiving slot 1320. Pairs of first retention portions 152 bend upwardly from outer periphery edge of the first base portion 151 and toward the cover plate 13 corresponding to the retaining slits 1322 for being engagingly received in the retaining slits 1322. The first base portion 151 forms a first retaining tab 153 (FIG. 4) bending downwardly toward the actuating mechanism 12 in a center thereof and defines a rectangular hole 154 to accommodate the first retention tab 153. A pair of opposite restriction portions 155 are symmetrically arranged with opposite longitudinal edges of the first base portion 151 and bend toward the actuating mechanism 12. A pair of through slits 157 are defined in opposite lateral ends of the first base portion 151 adjacent to a pair of first retention portions 152.

The actuating mechanism 12 comprises a rotator 14 penetrating through the cover 11 and a transmission element 16 connecting with the rotator 14. The rotator 14 comprises a driving portion 141 and an operating portion 142. The driving portion 141 is substantially a column and the operating portion 142 is hollow with a diameter thereof is larger than that of the driving portion 141. A transverse depression is recessed downwardly from upper surface of the driving portion 141 for being rotated by a tool (not shown) to rotate the rotator 14. An L-shape latch hook 1421 (FIG. 4) downwardly extends downwardly from the outer periphery edge of the operating portion 142.

The transmission element 16 is a substantially flat board and comprises a main body 160 defining a receiving opening 1600 corresponding to the latch hook 1421 for receiving the latch hook 1421 therein to connecting one end of the rotator 14 with the transmission element 16. The main body 160 defines a first receiving slot 1602 to receive the first retention tab 153. A pair of enhancing ribs 1601 bends upwardly from opposite longitudinal edges of the transmission element 16 toward the first base portion 151 to abut against the first base portion 151 for preventing curved deformation of the transmission element 16. The transmission element 16 is capable of rotating relative to the first retention tab 153 and the rotation range is restricted by the pair of restriction portions 155. In an alternative embodiment of the present invention, the transmission element 16 also can be anchored to the cover 11 directly via the cover 11 forms a tab inserted into the first receiving slot 1602 of the transmission element 16 or the cover 11 defines a first receiving slot to receive a tab formed on the transmission element 16.

The base 10 comprises a base plate 18 defining a plurality of contact-receiving passages (not shown) and a second connecting member 17 retained to a top side of the base plate 18. A plurality of contacts (not shown) are accommodated in the contact-receiving passages for electrically connecting the pins of the chip module to realize the electrical connection between the chip module and the electrical connector 1. The base plate 18 comprises a supporting portion 180 and a receiving portion 182. The second connecting member 17 comprises a second base portion 170 of a substantially flat board and forming a plurality of second retention portions 172 bending downwardly therefrom toward the receiving portion 182 of the base plate 18. Correspondingly, a plurality of base retaining slits 1822 are defined in the receiving portion 182 to receive the second retention portions 172 for realizing stable engagement between the second connecting element 17 and the base plate 18. An L-shape second retention tab 173 bends upwardly from a middle area of the second connecting member 17 toward the transmission element 16 to be received in a second receiving slot 1604 for connecting the second connecting member 17 with the transmission element 16. The first and second receiving slots 1602, 1604 communicate with each other. A pair of retention tabs 177 bend downwardly from opposite lateral ends of the second base portion 170 to be received in the through slits 157 of the first connecting member 15 to position the actuating mechanism 12 to the first and second connecting members 15, 17. Of course, in an alternative embodiment of the present invention, the transmission element 16 also can be directly anchored to the base plate 18 with a tab of the base plate 18 received in the second receiving slot 1604 of the transmission element 16 or a tab of the transmission element 16 received in a second receiving slot of the base plate 18.

Figure 4:
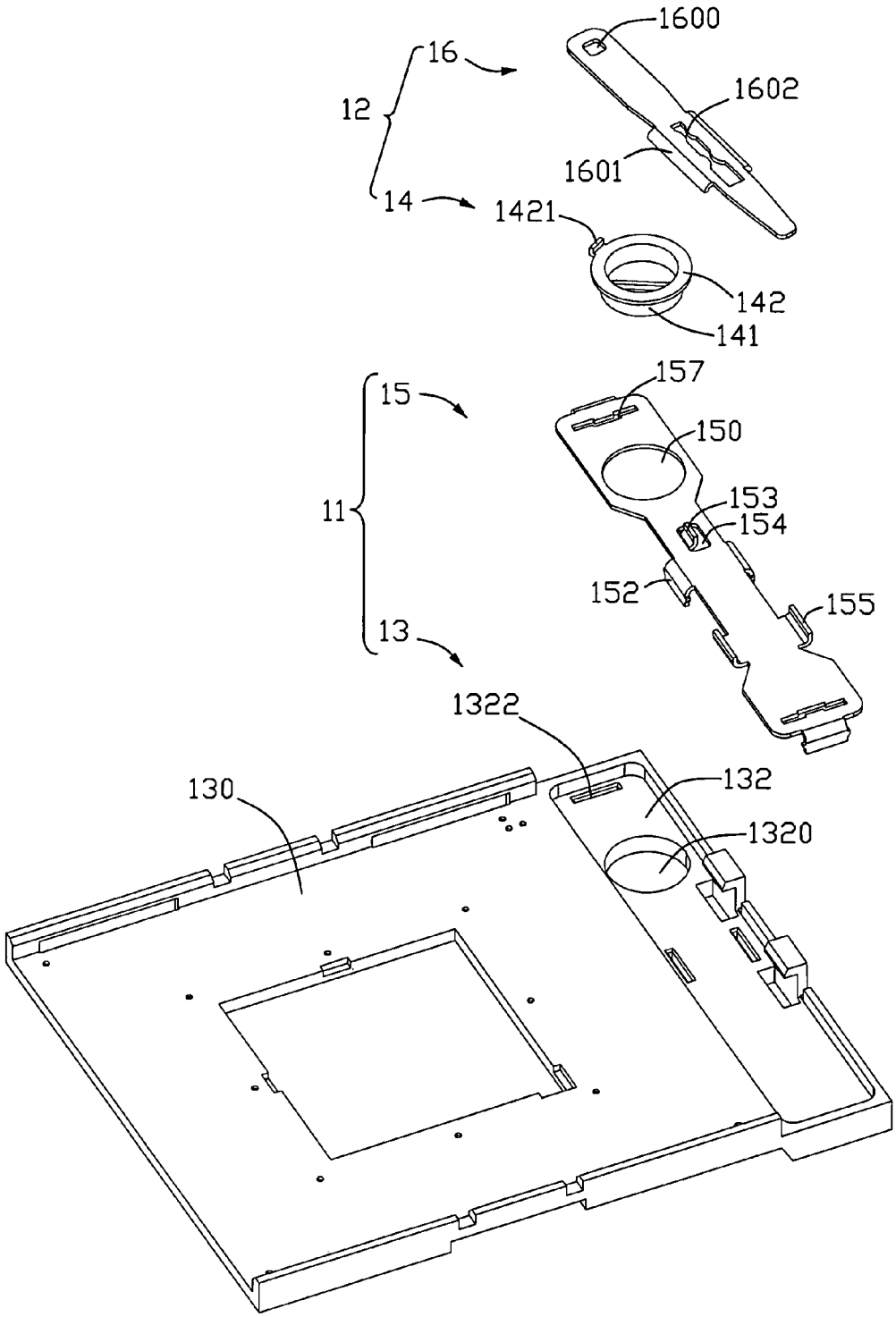
FIG. 4 is a partially exploded, perspective view of a cover and the actuating mechanism.
Figure 5:
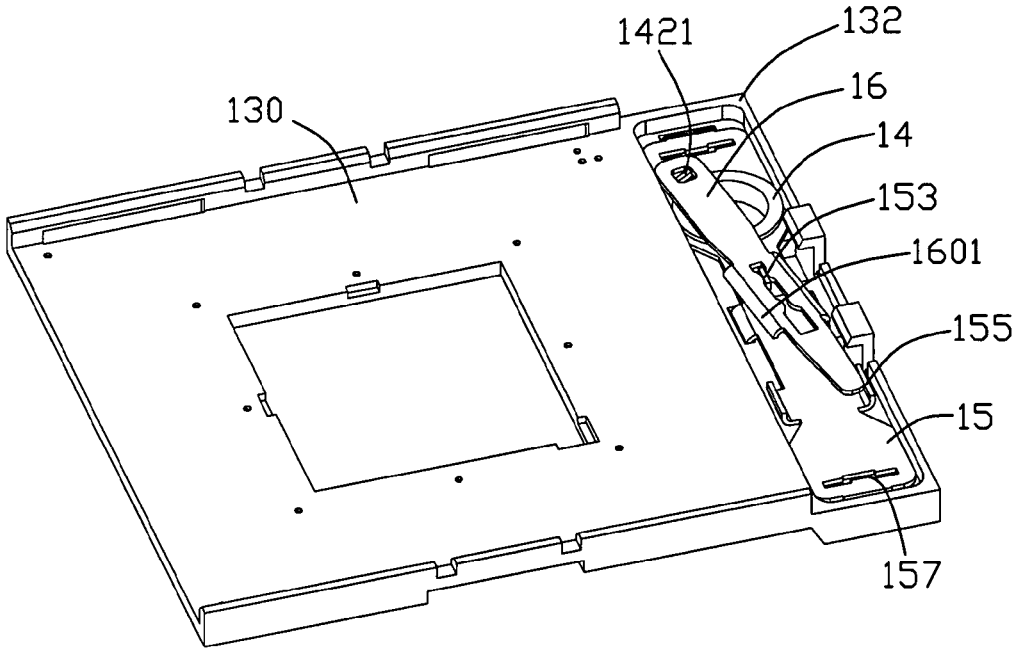
FIG. 5 is an assembled view of FIG. 4.

Please refer to FIGS. 4-5, the first connecting member 15 is assembled to the cover plate 13 with the first retention portions 152 interferentially inserted into the cover retaining slits 132 of the cover plate 13 to connect the cover plate 13 with the first connecting member 15 to form the cover 11. Then the rotator 14 is disposed into the circular hole 150 and the cover-receiving slot 1320 with the larger operating portion 142 abutting against a bottom surface of the first connecting member 15. Then the transmission element 16 is assembled to the rotator 14 with the latch hook 1421 received in the receiving opening 1600, the first retention tab 153 disposed in the first receiving slot 1602 and the enhancing ribs 1601 abutting against the bottom surface of the first connecting member 15. Hence, when the rotator 14 is rotated by the tool, the latch hook 1421 actuates the free end of the transmission element 16 to pivot. Since the first retention tab 153 is received in the first receiving slot 1602, the transmission element 16 actuates the first retention tab 153 to rotate. Therefore, the cover plate 13 is actuated to slide and the rotation range is restricted by the pair of restriction portions 155.

Figure 6:
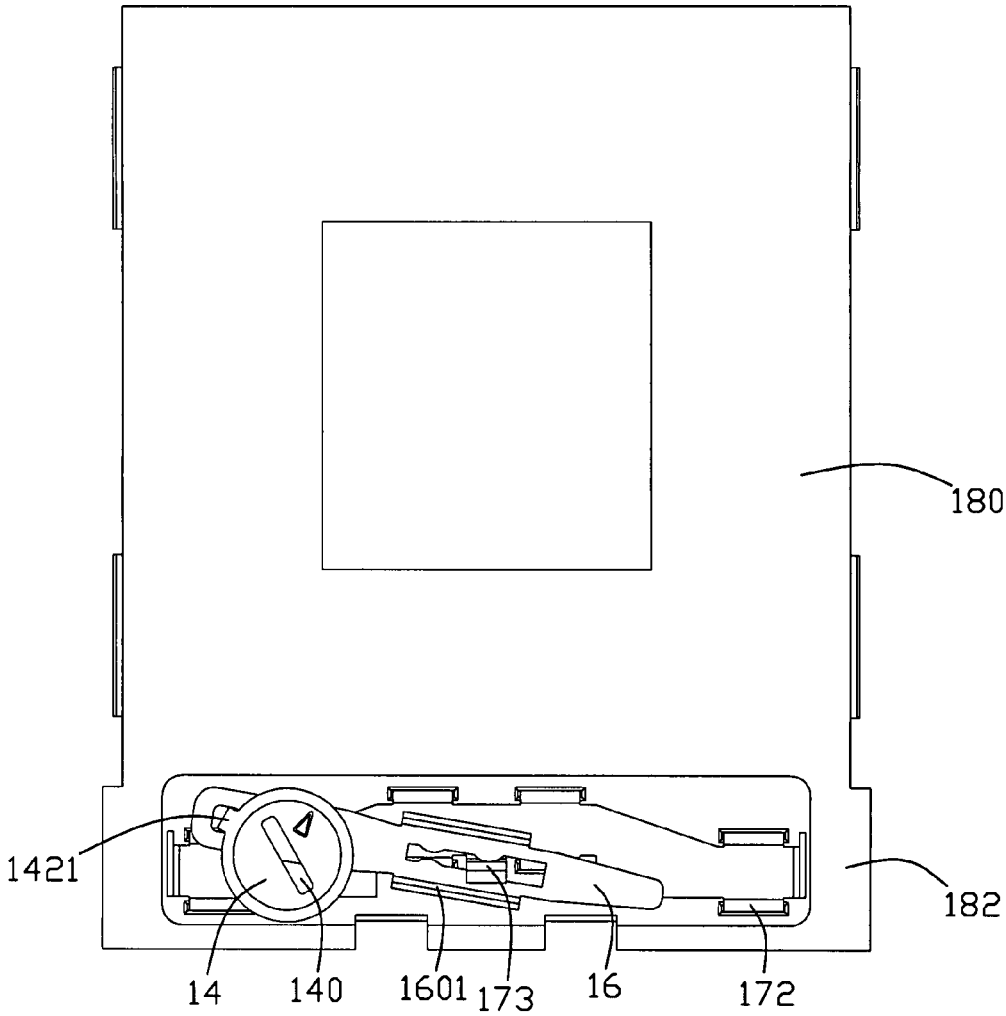
FIG. 6 is an assembled, perspective view to illustrate the actuating mechanism in an open position relative to a base.
Figure 7:
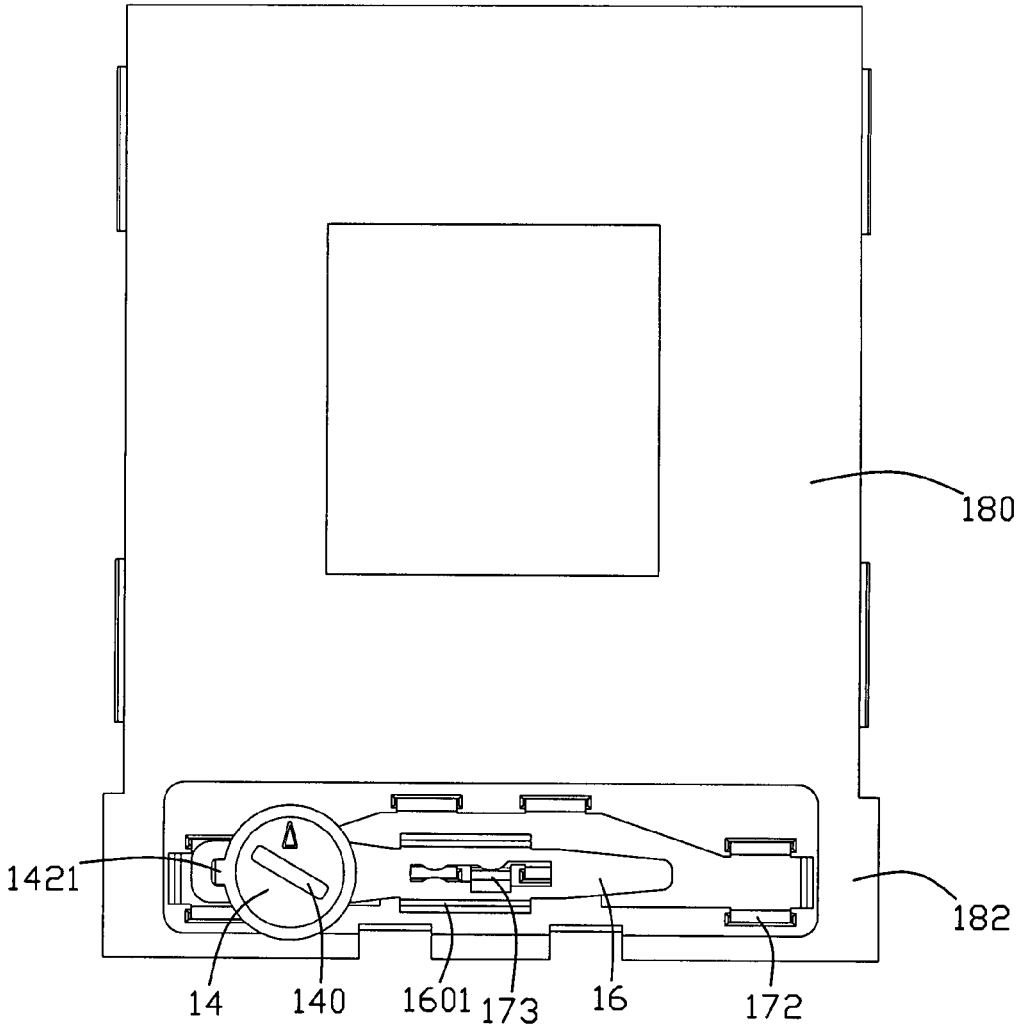
FIG. 7 is an assembled, perspective view to illustrate the actuating mechanism in an intermediate position relative to the base.
Figure 8:
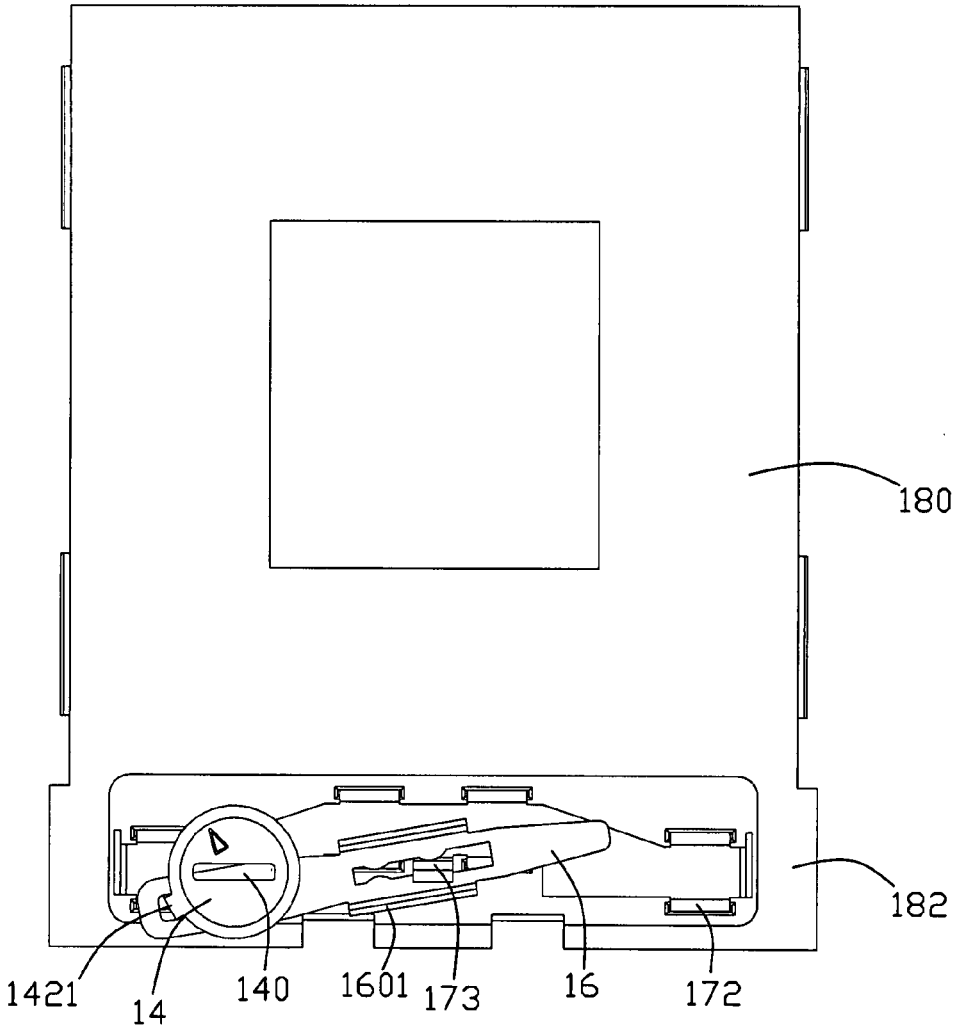
FIG. 8 is an assembled, perspective view to illustrate the actuating mechanism in a close position relative to the base.

FIGS. 6-8 show three positions of the actuating mechanism 12 relative to the base 10, that is, an open position, an intermediate position and a close position. The second retention portions 172 are interferentially received in the base retaining slits 1822 to connect the base plate 18 with the second connecting member 17. The transmission element 16 is disposed on the second connecting member 17 with the second retention tab 173 disposed in the second receiving slot 1602. When the rotator 14 is rotated by the tool, the latch hook 1421 actuates the transmission element 16 to rotate. Since the second retention tab 173 is disposed in the second receiving slot 1604, the second connecting member 17 is retained to the base plate 18 and the base plate 18 is fixed to a printed circuit board. Therefore, the rotator 14 actuates the transmission element to rotate from an open position (FIG. 6), an intermediate position (FIG. 7) to a close position (FIG. 8).

Please refer to FIGS. 2-3, the driving portion 141 of the rotator 14 is disposed in the circular hole 150 of the first connecting member 15 with the first retention tab 153 received in the first receiving slot 1602, the latch hook 1421 received in the receiving opening 16000. Then, the second connecting member 17 is latchably assembled to the first connecting member 17. Then, the opposite retention tabs 177 are interferentially received in the through slits 157, the second retention tab 173 is received in the second receiving slot 1604. When the rotator 14 is rotated by the tool, the latch hook 1421 drives the transmission element 16 to rotate. Since the second retention tab 173 latching with the transmission element 16 is also retained to the base plate 18 which is fixed to the printed circuit board, the first retention tab 153 received in the first receiving slot 1602 of the transmission element 16 is driven to rotate by the transmission element 16, thus, the first connecting member 15 is driven to rotate in the range restricted by the pair of restriction portions 155 thereof. Since the first connecting member 15 connects with the cover plate 13, the cover plate 13 is capable of sliding relative to the base plate 18.

It should be pointed out that, in the preferred embodiment of the present invention, the first connecting member 15 provides the first retention tab 153 and the restriction portions 155 to restrict the rotation range, the first retention tab 153 and the pair of restriction portions 155 also can extend integrally from the base plate 13 toward the transmission element 16, that is to say, the first connecting member 15 is not necessary in an alternative embodiment. Further, the second connecting member 17 of the preferred embodiment of the present invention provides the second retention tab 173 engaging with the transmission element 16 and the retention tabs 177 retained to the first connecting member 15. However, the second retention tab 173 and the retention tabs 177 also can extend integrally from the base plate 18 toward the transmission element 16, that is to say, the second connecting member 17 is not a necessary in an alternative embodiment. Further, in the preferred embodiment of the present invention, the rotator 14 and the transmission element 16 are connected to each other via the engagement between the latch hook 1421 and the receiving opening 1600. However, the latch hook can be provided by the transmission element 16 and the rotator 14 provide the receiving opening to realize the connection between the rotator 14 and the transmission element 16. Further, the base 10 and the cover 11 respectively provide the first and second retention tabs 153, 173 toward the transmission element 16 and the transmission element 16 provides the first and second receiving slots 1602, 1604 to receive the first and second retention tabs 153, 173. However, it is also available that the base 10 and the cover 11 provide the receiving slots, and the transmission element 16 provides retention tabs to connect the transmission element 16, the base 10 and the cover 1. In the preferred embodiment of the present invention, the first and second connecting members 15, 17 consist a protecting mechanism of the electrical connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a base defining a plurality of contact-receiving passages;

a cover slidably mounted to an upper surface of the base; and an actuating mechanism disposed between the base and the cover and comprising a rotator penetrating through the cover and a transmission element connecting with all of the rotator, the base and the cover; and wherein the rotation of the rotator drives the transmission element to pivot relative to the base, the movement of the transmission element driving the cover to slide relative to the base.

2. The electrical connector as claimed in claim 1, wherein at least one of the cover and the transmission element provides a first retention tab, and wherein the other of the cover and the transmission element provides a first receiving slat to receive the first retention tab to farm the connection between the cover and the transmission element.

3. The electrical connector as claimed in claim 2, wherein the cover comprises a cover plate and a first connecting member disposed below the cover plate, and wherein said first retention tab extends from the first connecting member toward the transmission element.

4. The electrical connector as claimed in claim 3, wherein the first connecting member comprises a substantially flat first base portion forming at least a pair of first retention portions bending toward the cover plate, and wherein the cover plate defines at least a pair of cover receiving slits to receive the first retention portions.

5. The electrical connector as claimed in claim 3, wherein the first base portion of the first connecting member forms a pair of restriction portions bending toward the transmission element, and wherein the transmission element is capable of rotating between the pair of restriction portions.

6. The electrical connector as claimed in claim 2, wherein at least one of the base and the transmission element provides a second retention tab, and wherein the other of the base and the transmission element provides a second receiving slot to receive the second retention tab to form the connection between the base and the transmission element.

7. The electrical connector as claimed in claim 6, wherein said base comprises a base plate and a second connecting member retained to the base plate, and wherein said second retention tab extends from the second connecting member toward the transmission element.

8. The electrical connector as claimed in claim 1, wherein said transmission element comprise a main body forming at least a pair of enhancing ribs bending toward the base, and wherein the at least a pair of enhancing ribs abut against the base.

9. The electrical connector as claimed in claim 3, wherein said base comprises a base plate and a second connecting member, and wherein said second connecting member is retained to the base plate and the first connecting member.

10. The electrical connector as claimed in claim 1, wherein the cover comprises a cover plate and a second connecting member, and wherein the second connecting member forms at least a pair of second retention portions, and the cover plate defines at least a pair of base receiving slits to receive the second retention portions.

11. An electrical connector, comprising:

stationary base defining a plurality of contact-receiving passages and adapted for being fixed to a printed circuit board;

a plurality of contacts received in the contact-receiving passages adapted for electrically connecting with the printed circuit board;

a moveable cover sliderably mounted to the base adapted for supporting a chip module which electrically connects the contacts to form electrical connection with the printed circuit board, the cover comprising a pair of restriction portions; and an actuating mechanism disposed between the base and the cover and comprising a rotator penetrating through the cover and a transmission element connecting with the rotator, the base and the cover; and wherein the transmission element is capable of being driven by the rotator to drive the cover to slide relative to the stationary base and is capable of moving between the pair of restriction portions.

12. The electrical connector as claimed in claim 11, wherein the base comprises a base plate and a first connecting member assembled to the bottom side of the base plate, and wherein at least one of the base plate and the first connecting member farms said pair of restriction portions to restrict the rotating range of the transmission element.

13. The electrical connector as claimed in claim 11, wherein at least one of the cover and the transmission element provides a first retention tab, and wherein the other of the cover and the transmission element provides a first receiving slot to receive the first retention tab to form the connection between the cover and the transmission element.

14. The electrical connector as claimed in claim 11, wherein at least one of the base and the transmission element provides a second retention tab, and wherein the other of the base and the transmission element provides a second receiving slot to receive the second retention tab to form the connection between the base and the transmission element.

15. The electrical connector as claimed in claim 11, further comprising a protecting mechanism positioned between the cover and the base, and wherein the protecting mechanism comprises a first connecting member moveable along with the cover and a second connecting member stationarily retained to the base.

16. The electrical connector as claimed in claim 15, wherein the transmission element is positioned between the first and second connecting members and capable of actuating the first connecting member to move relative to the second connecting member.

17. An electrical connector comprising:

a stationary base defining a plurality of contact-receiving passages and adapted for being fixed to a printed circuit board;

a plurality of contacts received in the contact-receiving passages adapted for electrically connecting with the printed circuit board;

a moveable cover sliderably mounted to the base adapted for supporting a chip module which electrically connects the contacts to form electrical connection with the printed circuit board; and an actuating mechanism comprising a rotator synchronically moveable along with the cover in a front-to-back direction, and a transmission element defining first, second and third holes respectively engaged with the rotator, the base and the cover; and wherein one of said second and third holes performs a fulcrum of the transmission element, by which the other of said second and third holes is located.

18. The electrical connector as claimed in claim 17, wherein said one is the third hole, and the other is the second hole.

* * * * *